US006444088B2

(12) United States Patent
Rökman et al.

(10) Patent No.: US 6,444,088 B2
(45) Date of Patent: Sep. 3, 2002

(54) FOAM PROCESS WEB PRODUCTION WITH FOAM DILUTION

(75) Inventors: Kay Rökman; Juhani Jansson, both of Karhula (FI)

(73) Assignee: Ahlstrom Glassfibre Oy, Karhula (FI)

( * ) Notice: Subject to any disclaimer, the term of this patent is extended or adjusted under 35 U.S.C. 154(b) by 0 days.

(21) Appl. No.: 09/779,628

(22) Filed: Feb. 9, 2001

Related U.S. Application Data

(62) Division of application No. 09/257,239, filed on Feb. 25, 1999, now abandoned.

(51) Int. Cl.[7] ..... D21F 1/02

(52) U.S. Cl. ..... 162/101; 162/190; 162/289; 162/336; 162/343

(58) Field of Search ..... 162/101, 190, 162/289, 336, 343, 350, 315

(56) References Cited

U.S. PATENT DOCUMENTS

| | | | |
|---|---|---|---|
| 3,716,449 | A | 2/1973 | Gatward et al. |
| 3,871,952 | A | 3/1975 | Robertson |
| 3,937,273 | A | 2/1976 | Radvan et al. |
| 3,938,782 | A | 2/1976 | Robertson |
| 4,049,491 | A | 9/1977 | Brandon et al. |
| 4,443,297 | A | 4/1984 | Cheshire et al. |
| 4,686,006 | A | 8/1987 | Cheshire et al. |
| 4,944,843 | A | 7/1990 | Wallace et al. |
| 5,011,575 | A | 4/1991 | Keller |
| 5,853,545 | A | 12/1998 | Haraldsson |
| 5,904,809 | A | 5/1999 | Rökman |

*Primary Examiner*—Peter Chin
*Assistant Examiner*—Mark Halpern
(74) *Attorney, Agent, or Firm*—Nixon & Vanderhye, P.C.

(57) ABSTRACT

A nonwoven web of fibrous material is made by the foam process using a manifold of a particular construction. The manifold has a casing with first and second opposite ends including an inlet for a foam-fiber-surfactant slurry at the first end, and optionally a valved outlet at the second end. A center section of the manifold casing has a (e.g. rectangular) cross-section that becomes smaller moving from an inlet toward the outlet. First and second substantially closed side walls, a porous front wall having an effective length, and a back wall opposite the front wall, are provided for the center section, the walls planar or curved. Any suitable structures are provided for introducing a second (e.g. substantially fiber-free, or a fiber-foam slurry) foam into the center section through the back wall. Pressure sensors penetrating one or both of the side walls may sense the pressure within the center section, and automatically control the introduction of slurry into the inlet, withdrawal through the outlet, and/or introduction of the second foam into/through the back wall, so as to maintain the basis weight of the foam-fiber slurry passing through the front wall substantially constant along the effective length of the front wall.

8 Claims, 7 Drawing Sheets

FOAM
98
30I
44
92
30I
93
FOAM
45
94
90
FIBER/
FOAM
29
45
91
32
29
31

FOAM PROCESS WEB PRODUCTION WITH FOAM DILUTION

This application is a division of application Ser. No. 09/257,239, filed Feb. 25, 1999, which was abandoned on Jun. 18, 2001.

BACKGROUND AND SUMMARY OF THE INVENTION

Co-pending application Ser. No. 08/923,250 filed Sep. 4, 1997, now U.S. Pat. No. 5,904,809 discloses a foam-laid process, and apparatus for practicing the process, for forming nonwoven fibrous webs which increase the uniformity of the basis weight profile of the nonwoven web produced. The invention provides a manifold, and method, facilitating production of a nonwoven web by the foam process which is a modification of the method and apparatus in said co-pending application by which it is also possible to increase the uniformity of the basis weight profile, allowing a basis weight variation of less than 0.5%, and in fact as low as 0.2% and even lower, depending upon the fibers utilized.

The profile of the nonwoven web produced by the foam process is very much dependent upon the manifold distribution tube construction and design. In the liquid process which uses water, and nearly Newtonian liquids, one tries to make the profile uniform by adjusting both static and dynamic pressure characteristics of the fiber-liquid slurry, including by changing the shape of the back wall of the manifold, and by varying the pressure in the manifold by controlling an outlet valve from the manifold. Foam-fiber-surfactant slurry, however, behaves differently than Newtonian, or near Newtonian liquids, making adjustments of the profile difficult when utilizing conventional manifold pipes. These problems can be greatly magnified if the particular fibers (or particles in the slurry) do not properly flow through the outlet valve in the manifold, are unstable in water, are sensitive to flocculation, or to build-up of knots or filter bundles.

According to the present invention, a manifold facilitating production of a nonwoven web using the foam process, and the foam process for producing nonwoven webs using the manifold, are provided which allow precise control of manifold pressure locally, and simultaneously over substantially the entire length of, the manifold. The web profile and formation can be precisely controlled. Control can be effected by one, or preferably all of, the back pressure established by controlling the outlet valve, feed rate to the manifold, and the feed rate of substantially fiber-free foam into the back wall of the manifold.

According to one aspect of the present invention a manifold facilitating production of a nonwoven web of fibrous material is provided comprising the following components: A manifold casing comprising first and second opposite ends, including an inlet for a foam-fiber slurry at the first end. A center section of the manifold casing having a substantially decreasing effective cross-sectional area from the inlet to the outlet. First and second side walls, a front wall having an effective length, and a back wall, of the center section. The front wall being porous to the foam-fiber slurry to allow passage of the slurry therethrough. Means for introducing a second foam (e.g. substantially fiber free, or a foam fiber slurry, which may include surfactant) into the center section through the back wall. And, the means for introducing the second foam (and perhaps the shape and dimensions of the center section) being constructed so as to facilitate maintaining the basis weight of foam-fiber slurry passing through the front wall substantially constant along the effective length of the front wall.

A significant feature of the manifold is a decreasing cross sectional area from the inlet towards the outlet. The decrease of the cross-sectional area depends on three factors; the amount of slurry discharged from the manifold towards the headbox, the kinetic energy of the slurry inside the manifold, and the surface friction between the manifold walls and the slurry. The manifold may have any shape that takes these into account. For instance, the manifold could be a cylindrical pipe having a conical member therein for decreasing the cross-sectional area. In such a structure the nozzles leading the slurry out of the manifold may be positioned around the cylindrical manifold at all directions, and the pipes supplying the second foam could be disposed at the conical pipe inside the manifold. In this case the side walls and the front wall and back wall are part of a continuous curved structure. In fact, the cross-section of the entire front wall, back wall, and side walls are preferably cylindrical.

Alternatively, the manifold could be two sided i.e. the nozzles attached to the opposite sides of the manifold so that the fiber free foam could be introduced through the other opposite walls where the cross-section of the manifold is rectangular.

The orientation of the manifold typically has very little significance; it may be disposed either in an upright, inclined or horizontal position.

The means for introducing the substantially fiber-free foam into the center section through the back wall may comprise any conventional fluid components including nozzles, perforated plates, baffles, spray heads, or the like. Preferably such means comprises one or more lines of valved pipes, the valves being controllable to vary the amount of foam passing therethrough.

In the preferred embodiment of the manifold the back wall of the center section slopes with respect to the front wall so that the back wall becomes closer to the front wall, and the cross-sectional area of the center section becomes smaller, moving from adjacent the first end of the manifold toward the second end. Preferably the side walls are substantially closed and the back wall is substantially closed except for the means for introducing substantially fiber free foam; and the manifold may further comprise an outlet at the second end of the manifold, in which case the fiber-foam mixture can be recirculated. [A valve may preferably be disposed in the outlet to vary the amount of slurry passing through the outlet.] The front wall may be substantially horizontal, or it may have other orientations. The manifold is typically provided with nozzles and conduits leading the slurry to a headbox, in combination with a moving foraminous element (such as a wire) on which a nonwoven web is formed by slurry passing through the front wall into the nozzles and conduits, and then into the headbox; and in a downstream former foam and liquid are sucked out of the slurry to form the web on the foramininous element.

The manifold may further comprise a plurality of pressure sensors operatively connected to at least one of the substantially closed side walls for sensing the pressure within the center section thereat. Still further the manifold may comprise control means responsive to the pressure sensors for controlling at least one of (preferably all of) introduction of foam-fiber slurry, withdrawal of foam-fiber slurry, and introduction of substantially fiber free foam, into the center section to maintain the basis weight of foam-fiber slurry passing through the front wall substantially constant along the effective length of the front wall. The control means may comprise any conventional type of computer control, fuzzy controller, a multi-variable control unit, or the like that cooperates with valves, baffles, or other conventional fluidic elements to perform the desired function automatically.

The cross-section of the center section may be a parallelogram, or a wide variety of other types of polygons or other shapes (as described above), but preferably is substantially rectangular. The manifold center section typically comprises a polygonal base prism, such as a rectangular base prism.

According to another aspect of the present invention a manifold facilitating production of a nonwoven web of fibrous material is provided comprising the following components: A manifold casing comprising first and second opposite ends, including an inlet for a foam-fiber slurry at the first end, outlet at the second end of the manifold, and a valve disposed in the outlet to vary the amount of slurry passing through the outlet. A center section of the manifold casing having a substantially polygonal cross-section. First and second side walls, a front wall having an effective length, and a back wall, of the center section. The front wall being porous to the foam-fiber slurry to allow passage of the slurry therethrough. Means for introducing a second foam into the center section through the back wall. And, wherein the back wall of the center section slopes with respect to the front wall so that the back wall becomes closer to the front wall, and the cross-sectional area of the center section becomes smaller, moving from adjacent the first end of the manifold toward the second end. The details of the manifold are preferably as described above.

The invention also relates to a method of producing a nonwoven web of fibrous material using a manifold having a front porous wall having an effective length through which foam-fiber slurry can flow, first and second ends separated along the effective length, and a back wall opposing the front wall; and a headbox. The method preferably comprises: (a) Substantially continuously introducing foam-fiber-surfactant slurry into the first end of the manifold. (b) Substantially continuously discharging foam-fiber-surfactant slurry through openings in the manifold front wall to be delivered to the headbox. And, (c) Introducing a second foam (e.g. substantially fiber free, or a fiber-foam slurry having approximately the same, or a different (e.g. by at least about 1%), percentage of fibers as the foam-fiber slurry introduced at (a)) into the manifold through a number of openings spaced at substantially regular intervals substantially over the entire length thereof, so as to maintain the basis weight of foam-fiber-surfactant slurry passing through the manifold front wall substantially constant along the effective length of the manifold front wall.

The method preferably further comprises (d) sensing the pressure in the manifold at a plurality of positions along the length thereof, and practicing (c) in response to the sensed pressure to maintain the basis weight of foam-fiber slurry passing through the front wall has a variation of less than 0.5% along the effective length of the front wall. Preferably (c) is also practiced substantially continuously. Preferably the manifold has a center section between the first and second ends thereof with a substantially polygonal cross-section that gradually decreases substantially along the effective length of the front wall, and in that case (c) is practiced so that the foam-fiber-surfactant slurry moves through the constantly decreasing cross-section of the center section. Also, the method typically further comprises (e) substantially continuously withdrawing some slurry through the second end of the manifold.

It is the primary object of the present invention to provide a manifold, and method of producing a nonwoven web of fibrous material utilizing the manifold, which takes into account the non-Newtonian aspects of the foam-fiber-surfactant slurries, to produce a nonwoven web of substantially constant basis weight along the effective length of the front wall of the manifold. This and other objects of the invention will become clear from an inspection of the detailed description of the invention, and from the appended claims.

DETAILED DESCRIPTION OF THE DRAWINGS

Figure 1:
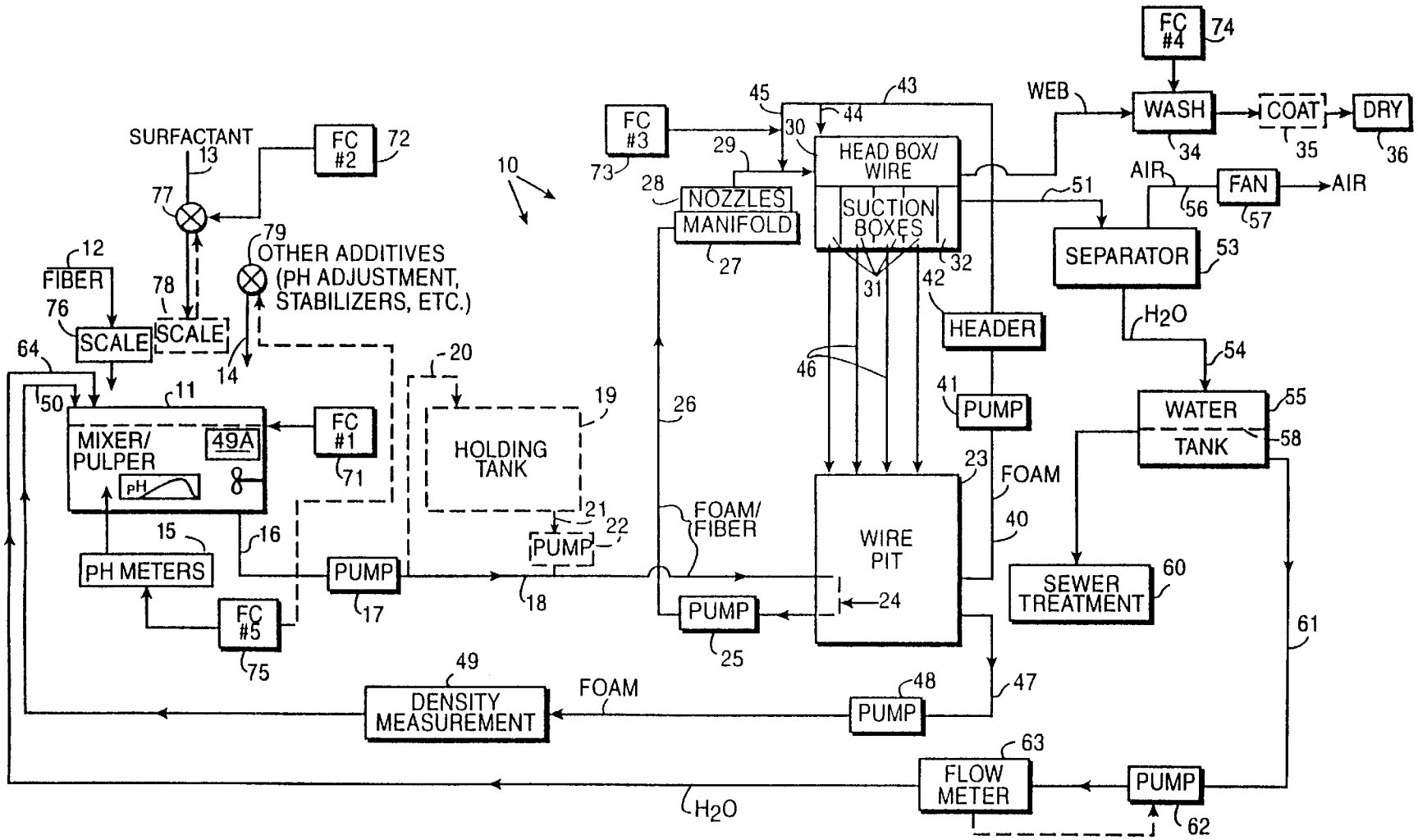
FIG. 1 is a general schematic illustration of a foam laid process system in which the method of the invention may be practiced and the apparatus of the invention utilized.

An exemplary foam-laid process system for practicing a foam laid process with which the invention is desirably utilized is illustrated schematically at 10 in FIG. 1. The system includes a mixing tank or pulper 11 having a fiber input 12, a surfactant input 13, and an input 14 for other additives, such as pH adjustment chemicals like calcium carbonate or acids, stabilizers, etc. The particular nature of the fibers, surfactant, and additives is not critical and they may be varied widely depending upon the exact details of the product being produced (including its basis weight). It is desirable to use a surfactant that can be fairly readily washed out since a surfactant reduces the surface tension of the final web if it is still present, and that is an undesirable feature for some products. The exact surfactant used, from the thousands that are commercially available, is not part of the present invention.

The tank 11 is per se entirely conventional, being the same type of tank that is used as a pulper in conventional paper making systems using the water-laid process. The only differences are that the side walls of the mixer/pulper 11 are extended upwardly about three times the height in the water-laid process since the foam has a density about a third that of water. The rpm and blade configuration of the conventional mechanical mixer in the tank 11 is varied depending upon the particular properties of the product being produced, but is not particularly critical, and a wide variety of different components and variables may be employed. Brakers may also be provided on the walls. There is a vortex at the bottom of the tank 11 from which the foam drains, but the vortex is not visible once start up occurs because the tank 11 is filled with foam and fiber.

The tank 11 also preferably includes therein a large number of pH meters 15 for measuring the pH at a number of different points. pH affects surface tension, and thus desirably is accurately determined. The pH meters are calibrated daily.

At initial start up, water is added with the fiber from line 12, the surfactant from line 13, and other additives in line 14; however, once operation commences no additional water is necessary and there is also foam maintenance in the tank 11, not merely foam generation.

The foam exits the bottom of the tank 11, in a vortex, into line 16 under the influence of the pump 17. The pump 17, like all other pumps in the system 10, preferably is a degassing centrifugal pump. The foam discharged from the pump 7 passes in line 18 to further components.

FIG. 1 illustrates an optional holding tank 19 in dotted line. The holding tank 19 is not necessary but may be desirable to ensure a relatively even distribution of the fiber in the foam in case there is some variation that is introduced into the mixer 11. That is, the holding tank 19 (which is small, typically only on the order of five cubic meters) acts more or less like a "surge tank" for evening out fiber distribution. Because the total time from mixer 11 to the headbox (30) is typically only about 45 seconds in the practice of the process, the holding tank 19—if used—provides time for variations to even out.

When the holding tank 19 is used foam is fed from the pump 17 in line 20 to the top of the tank 19, and exits the bottom of the tank in line 21 under the influence of centrifugal pump 22, then leading to line 18. That is, when the holding tank 19 is used the pump 17 is not directly connected to the line 18, but only through the tank 19.

The line 18 extends to the wire pit 23. The wire pit 23 is per se a conventional tank, again the same as in the conventional water-laid paper process system, but with higher side walls. It is important to make the wire pit 23 so that there are no dead corners and therefore the tank 23 should not be too large. The conventional structure 24 which allows the foam and fiber mixture in line 18 to be introduced into the pump 25 (which is operatively connected adjacent the bottom of the wire pit 23) will be described further with respect to FIG. 2. In any event, the pump 25 pumps the foam/fiber mixture in line 18, introduced by mechanism 24, and additional foam from the wire pit 23, into the line 26. Because a fairly large amount of foam is drawn into the pump 25 from the wire pit 23, typically the consistency in line 26 is significantly less than that in line 18. The consistency in line 18 is typically between 2–5% solids (fibers), while that in line 26 is typically between about 0.5–2.5%, although the consistency in each case may be as high as about 12%.

In the wire pit 23 there is no significant separation of the foam into layers of different density. While there is a minimal increase toward the bottom, that degree of increase is small and does not affect operation of the system.

From the line 26 the foam/fiber passes to the manifold 27 which has foam generating nozzles 28 associated therewith. Preferably the nozzles 28—which are conventional foam generating nozzles (which agitate the foam greatly) as used in U.S. Pat. Nos. 3,716,449, 3,871,952, and 3,938,782, which are hereby incorporated by reference herein—are mounted on the manifold 27, and a large number of the nozzles 28 are mounted on the manifold 27. Extending from each nozzle 28 is a conduit 29 which leads to the headbox 30, through which one or more conventional paper making wires (foramininous elements) pass.

The headbox 30 has a plurality of suction boxes (typically about three to five) 31 which withdraw foam from the opposite side of the wire (foramininous element) from the introduction of the foam/fiber mixture, and a final separation box 32 is at the discharge end of the formed web 33 from the headbox 30. The number of suction boxes 31 provided in the suction table to control drainage are increased for denser products, or for higher speed operation. The formed web 33, which typically has a solids consistency of about 40–60% (e.g. about 50%), is preferably subjected to a washing action as indicated schematically by wash stage 34 in FIG. 1. The wash stage 34 is to remove the surfactant. The high consistency of the web 33 means that a minimum amount of drying equipment need be utilized.

The web 33 passes from the washer 34 past one or more optional coaters 35, to the conventional drying station 36. In the conventional drying station 36 when synthetic sheath/core fibers (such as Cellbond) are part of the web 33, the dryer 34 is operated to raise the web above the melting point of the sheath material (typically polypropylene) while the core material (typically PET) does not melt. For example where a Cellbond fiber is used in the web 33, the temperature in the dryer is typically about 130° C. or slightly more, which is at or slightly above the melting temperature of the sheath fiber, but well below the approximately 250° C. melting temperature of the core fiber. In that way a binding action is provided by the sheath material, but the integrity of the product (provided by the core fiber) is not compromised.

While it is not always necessary, the process contemplates the addition of pure foam to or immediately adjacent the headbox 30 for a number of advantageous purposes. As seen in FIG. 1, the centrifugal pump 41 draws foam from the wire pit 23 into line 40. The foam in line 40 is pumped to a header 42 which then distributes the foam to a large number of different conduits 43, toward the headbox 30. The foam may be introduced—as indicated by line 44—directly underneath the roof of the headbox 30 (where it is an incline wire headbox), and/or via conduits 45 to the lines 29 (or nozzles 28) for introducing foam/fiber mixture into the headbox 30. The details of the foam introduction will be described with respect to FIGS. 3 through 6.

The suction boxes 31 discharge the foam withdrawn from the headbox 30 in lines 46 into the wire pit 23. Typically no pumps are necessary, or used, for that purpose.

A significant amount of the foam in the wire pit 23 is recirculated to the pulper 11. The foam is withdrawn in line 47 by centrifugal pump 48, and then passes in conduit 47 through the conventional in-line density measurement device 49 for introduction—as indicated schematically at 50—back into the tank 11. In addition to providing density measurement for the foam in line 47 at 49, as schematically illustrated in FIG. 1 one or more density measuring units (such as denseometers) 49A may be mounted directly in the tank 11.

In addition to foam recycle, there is also typically water recycle. The foam withdrawn from the last suction box 32 passes via line 51 to a conventional separator 53, such as a cyclone separator. The separator 53—e.g. by vortex action—separates air and water from the foam introduced into the separator 53 to produce water with very little air in it. The separated water passes in line 54 from the bottom of the separator 53 to the water tank 55. The air separated by the separator 53 passes in line 56, with the assistance of the fan 57, from the top of the separator 53 and is discharged to atmosphere, or used in a combustion process or otherwise treated.

A liquid level 58 is established in the water tank 55, with some liquid overflowing to sewer or treatment, as indicated schematically at 60 in FIG. 1. Water is also taken from below the level 58 in the tank 55 via line 61, and under the influence of centrifugal pump 62 is pumped in line 61 through a conventional flow meter 63 (which controls the pump 62). Ultimately, the recycled water is introduced—as indicated schematically at 64 in FIG. 1—to the top of the mixer 11.

Typical flow rates are 4000 liters per minute foam/fiber in line 18, 40,000 liters per minute foam/fiber in line 26, 3500 liters per minute foam in line 47, and 500 liters per minute foam in line 51.

The system 10 also includes a number of control components. A preferred example of various alternatives for controlling the operation of the system comprises first fuzzy controller, 71, controls the level of foam in the tank 11. A second fuzzy controller 72 controls the addition of surfactant in line 13. A third fuzzy controller 73 controls web formation in the headbox 30 area. A fourth fuzzy controller 74 is used with the washer 34. A fifth fuzzy controller 75 controls the pH meters 15, and possibly controls addition of other additives in line 14 to the mixer 11. Fuzzy control is also used for surfactant and formation control. A multi-variable control system, and a Neuronet control system, also are preferably provided overlaying the other controls. The multi-variable control also is used for controlling the efflux ratio at web formation. The variables can be changed depending upon their effect on desired process regulation, and end result.

In order to facilitate control of the various components, typically a scale 76 is associated with the fiber introduction 12 in order to accurately determine the amount of fiber being added, per unit time. A valve 77 in line 13 may be provided for controlling the introduction of surfactant, as well as a scale 78. A valve 79 may also be provided in the line 14.

In the system 10 essentially no valves are provided for intentionally contacting the foam at any point during its handling, with the possible exception of level control valves provided in lines 46.

Also, during the entire practice of the process of the system of FIG. 1 the foam is kept under relatively high shear conditions. Since the higher the shear the lower the viscosity, it is desirable to maintain the foam at high shear. The foam/fiber mixture acts as a pseudo-plastic, exhibiting non-Newtonian behavior.

The use of the foam-laid process has a number of advantages compared to the water-laid process particularly for highly absorbent products. In addition to the reduced dryer capacity because of the high consistency of the web 33, the foam process allows even distribution of virtually any type of fiber or particle (without excessive "sinking" of high density particles while low density particles do "sink" somewhat—they do not sink at all in water) into the slurry (and ultimately the web) as long as the fibers or particles have a specific gravity between about 0.15–13. The foam process also allows the production of a wide variety of basis weight webs, a product with increased uniformity and higher bulk compared to water-laid process products, and a very high level of uniformity. A plurality of headboxes may be provided in sequence, or two (or more) strata may be made at the same time within a headbox with a double wire, etc., and/or the simple coaters 35 may be utilized to provide additional layers with great simplicity (like coating).

Figure 2:
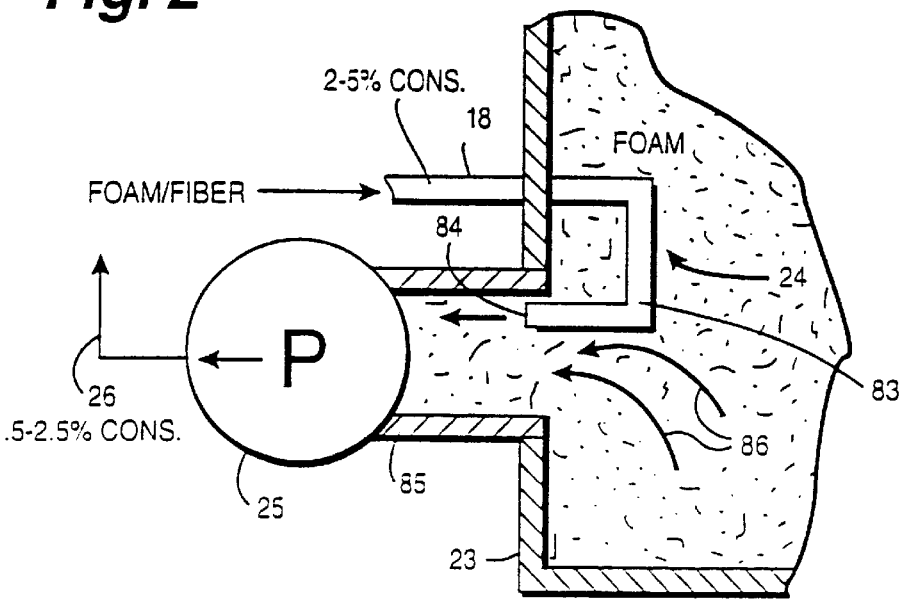
FIG. 2 is a detail schematic view, partly in cross-section and partly in elevation, showing the feed of a foam/fiber slurry from the mixer to the pump feeding the manifold and headbox of the system of FIG. 1.

FIG. 2 shows the introduction of foam/fiber mixture, and foam, to the pump 25 associated with the wire pit 23. The structure 24 is known from the Wiggins Teape process such as disclosed in the patents incorporated by reference herein, and the foam/fiber passing in line 18 is caused to be redirected as illustrated by the bent conduit 83 so that from the open end 84 thereof the foam/fiber mixture is discharged directly into the intake 85 of the pump 25. Foam from the wire pit 23 also flows into the inlet 85, as illustrated by arrows 86. Operation of pump 48, done under fuzzy control; controls the level in wire pit 23.

Where the fibers to be used to make the foam are particularly long, that is on the order of several inches, instead of directing the line 18 to the suction inlet 85 of the pump 25 (as seen in FIG. 2) the line 18 terminates in the line 26 downstream of the pump 25. In this case the pump 17 must of course provide a higher pressure than it otherwise would, that is sufficient pressure so that the flow from 18 is into the line 26 despite the pressure in line 26 from the pump 25.

Figure 3:
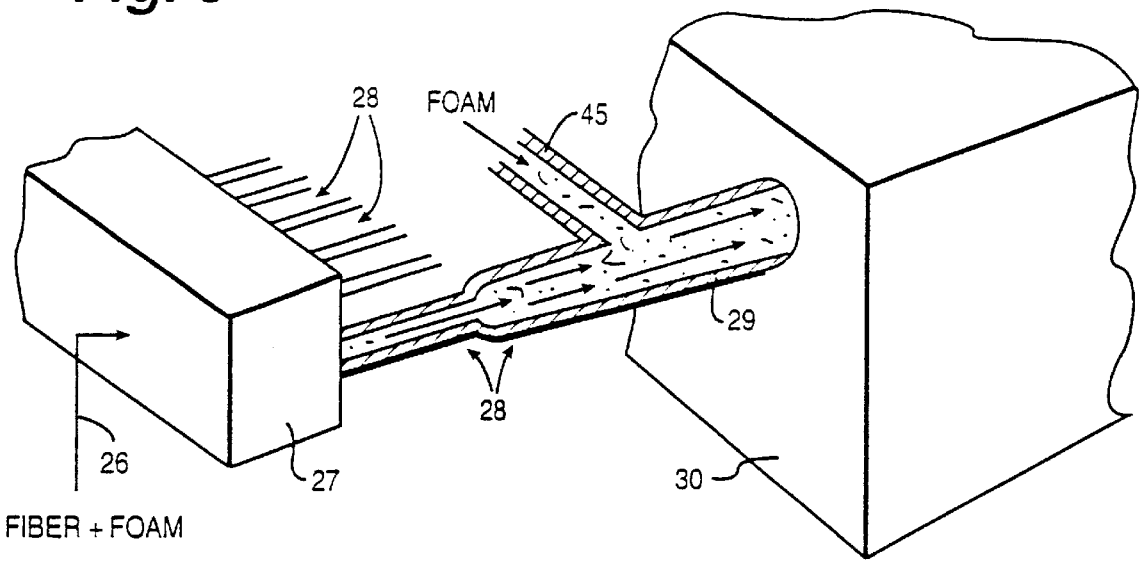
FIG. 3 is a perspective schematic detail view, partly in cross-section and partly in elevation, showing the addition of foam per se into the conduit between the manifold and the headbox, according to the invention.

FIG. 3 illustrates the details of one form of an additional foam introduction aspect of the process of the invention. FIG. 3 illustrates foam per se from lines 45 being introduced into the foam/fiber mixture in the conduit 29 just prior to the headbox 30. When foam injection lines 45 are utilized they need not inject foam into all of the lines 29, just enough of them to achieve the desired results. The desired results include (as a primary advantage) a more uniform basis weight profile. If desired the tubes 29 can lead the foam from the foam nozzles 28 to an explosion chamber in the headbox 30. However there is no real reason to use an explosion chamber in the headboxes for practicing the Ahistrom process. If used, an explosion chamber is solely for security.

The amount of pure foam added in lines 45, and exactly where it is added, must be determined empirically for each situation, being dependent upon the particular headbox 30 and other equipment used, the type and size of the fibers, and other variables. Under most circumstances the addition of pure foam that is somewhere between about 2–20% of the volume of the foam/fiber mixture gets the desired results.

Figure 4:
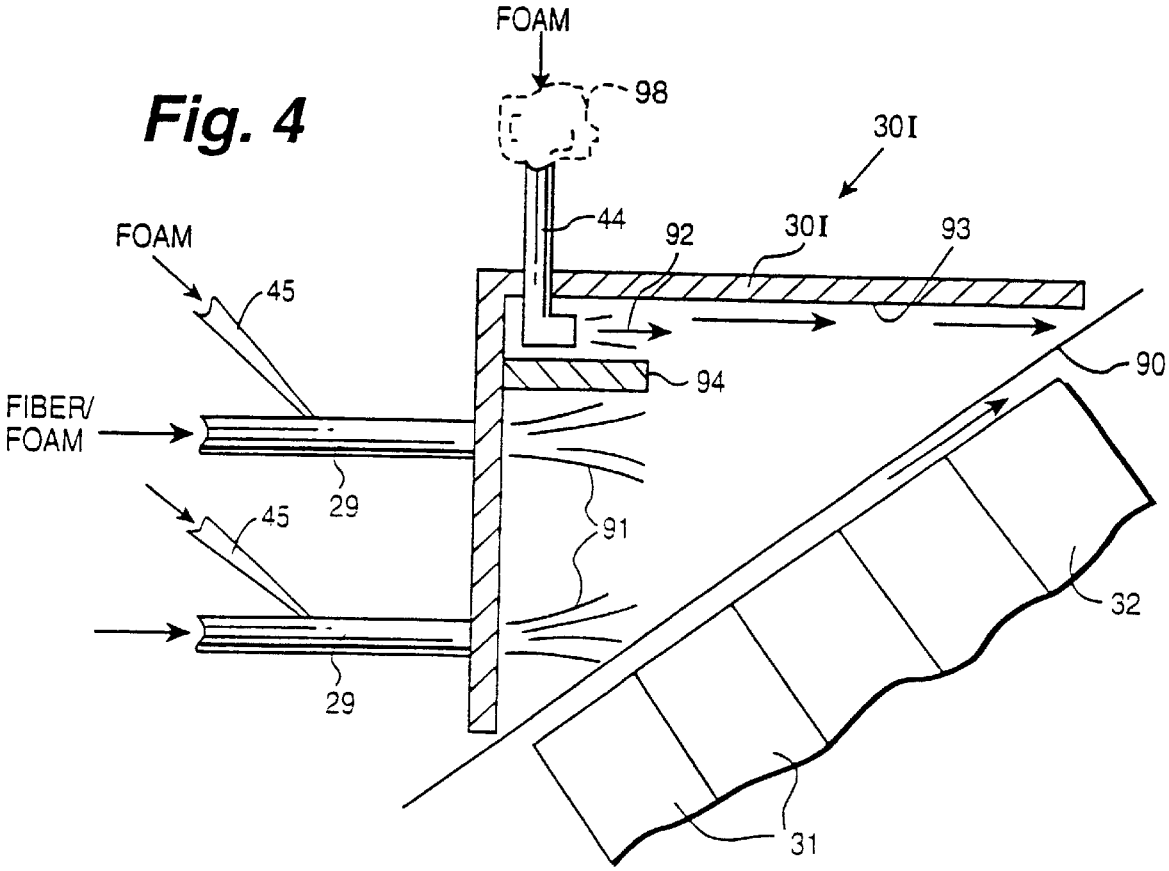
FIG. 4 is a side view, partly in cross-section and partly in elevation, of a detail of an exemplary inclined wire headbox using foam introduction.

FIG. 4 illustrates an exemplary incline wire headbox, 301, which utilizes two different forms of foam injection (the form illustrated in FIG. 3 plus another). In the headbox 301 of FIG. 4 the inclined conventional forming wire 90 moves in the direction of the arrow, and with foam injection at 45 the foam/fiber mixture is dispersed in to the headbox 301 from the conduits 29 generally as illustrated in FIG. 4. Foam is also introduced into headbox 301 via conduit 44 so that the foam flows generally as illustrated at arrow 92 in FIG. 4. That is the foam flowing in the direction of arrow 92 flows against the bottom of the roof 93 of the headbox 301. A baffle 94 may be provided in the headbox 301 to ensure the initial flow of the foam in the direction 92 from each of a plurality of the conduits 44.

The incline (e.g. about 45°) of the headbox 301 is preferred for a number of reasons. If the roof 93 of the headbox 301 is inclined upwardly in the direction of movement of the wire 90 any gas bubble formed at the top of headbox 301 will pass out of the headbox 301 on its own. If the wire 90 forming the bottom of the headbox 301 is horizontal the gas bubble will remain at the top of the headbox 301, and a special structure (e.g. valved conduit and/or pump) must be provided to remove it.

One reason the substantially pure foam is introduced in one or more conduits 44 is for the purpose of providing less shear of fibers in the headbox 301 so that the fibers in the slurry do not become unidirectional (generally in the direction of the movement of the wire 90). Under basic fluid dynamic principles, if the foam/fiber mixture is against the roof 93 the friction will cause the fiber orientation at the boundary layer to become unidirectional, which is undesirable. The foam introduced to flow in the direction 92 eliminates that boundary layer problem, acting as a lubricant.

The foam introduced in lines 44 may also have a desirable effect on the basis weight profile of the foam/fiber slurry 91. Also the foam introduced in lines 44 flowing in direction 92 keeps the bottom of the roof 93 clean, which is also desirable.

The amount of foam introduced in this way (via conduits 44) also must be determined empirically in each different situation, but normally the optimum will be somewhere within the range of about 1–10% of the volume of the foam/fiber mixture introduced by conduits 29.

Figure 5:
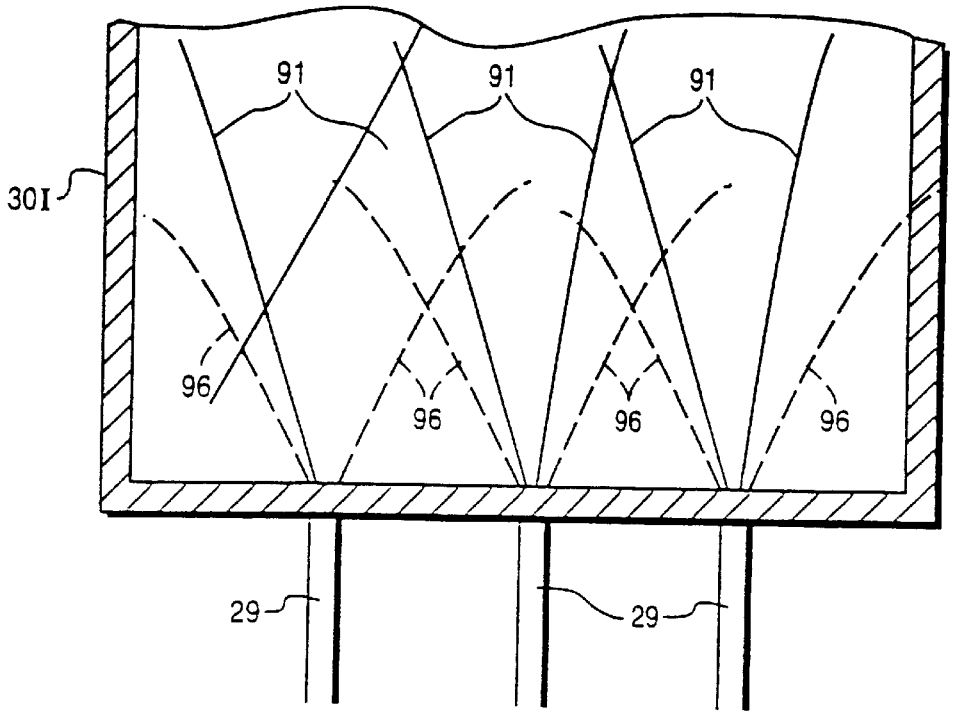
FIG. 5 is a schematic representation illustrating the affect of pure foam addition to the conduits leading from the manifold to the headbox.

The introduction of the foam in conduits 45 (typically at an angle of between about 30°–90°—compare FIGS. 3 and 4) as illustrated in both FIGS. 3 and 4, is for a different purpose. FIG. 5 is a schematic top view (showing only three conduits 29, whereas normally very many are provided) of the headbox 30 (e.g. 301) showing the difference pure foam injection makes. Without the injection of substantially fiber-free foam at 45 the foam/fiber mixture introduced by conduits 29 is distributed generally as indicated by lines 91 in FIGS. 4 and 5. However when there is foam injection at 45, the basis weight profile is changed because there is a greater dispersion of the foam fiber mixture, as schematically indicated by lines 96 in FIG. 5. The affect on the basis weight profile is seen in the schematic illustration in FIG. 6. The normal basis weight profile (when there is no foam injection), illustrated by line 91A, includes a large bulge 97. However when there is foam injection, as indicated by line 96*a* the bulge 98 is much smaller. That is, the basis weight is more uniform. Profile control is effected by adding the diluting foam at the manifold 27 main flow (e.g. before nozzles 28), or just before or just after the tubes 29 enter headbox 301 (just before being seen at 45 in FIG. 4), i.e. after nozzles 28.

If desired the tubes 29 can lead the foam from the foam nozzles 28 to an explosion chamber in the headbox 30, 301. However there is no real reason to use an explosion chamber in the headboxes for practicing the process of the invention. If used, an explosion chamber is solely for security.

As seen in dotted line in FIG. 4, a foam nozzle 98 may be provided in some or all of the conduits 44. Also, the basis weight profile may be adjusted using the foam flow 92 (alone or in combination with the flow in conduits 45). The conduits 44 may branch, one branch in direction 92, and another to intersect flows 91 (with baffle 94 removed, or penetrated by the second branch).

Utilizing the assemblies illustrated in FIGS. 3 through 5 it will be seen that the following method steps may be practiced: (a) A first foam slurry of air, water, fibers (e.g. synthetic and cellulosic fibers, although other fibers, such as glass fibers can be used), and any suitable surfactant, is fed into the headbox 301 and into contact with the moving foramininous element 90. (b) A first substantially fiber-free foam is introduced—as indicated by the arrow 92 in FIG. 4—into contact with the surface 93 (e.g. the roof) of the headbox 301 at a point remote from the foramininous element 90. Step (b) is typically practiced to cause foam to flow along the surface 93 toward the element 90 so as to minimize shear of fibers in the headbox 301 so that the fibers do not become unidirectional, in the general direction of movement of the foramininous element 90, and also so as to keep the surface 93 clean. And there is the step (c) of withdrawing foam through the foramininous element 90 to form a non-woven fibrous web on the element 90, withdrawal of foam being accomplished utilizing the suction boxes 31, 32 or any other suitable conventional device for that purpose (such as suction rollers or tables, pressing rolls, or the like).

Figure 6:
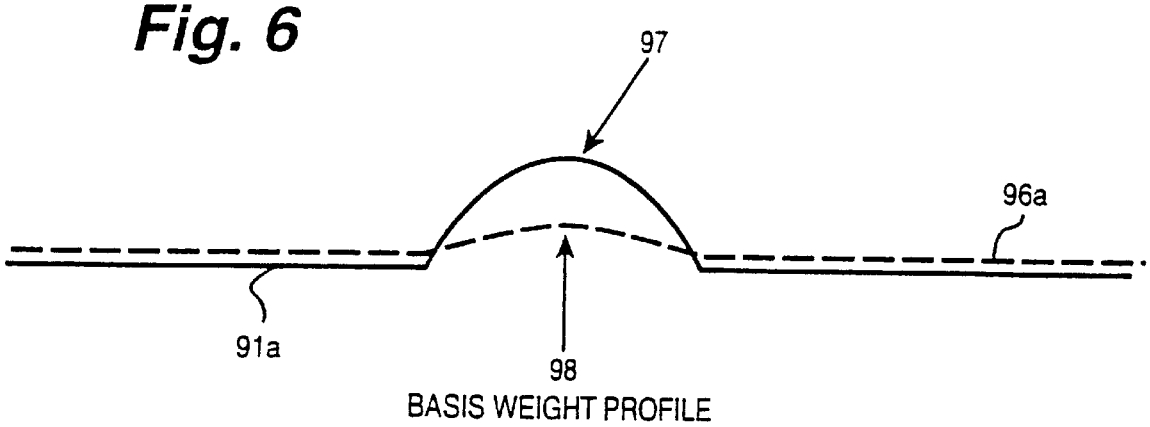
FIG. 6 is a schematic representation of the basis weight profile of the headbox of FIGS. 4 and 5 with and without pure foam addition.

There may also be a method—which can be seen in all of FIGS. 3 through 5—that includes the following steps: (a) Feeding a first fiber-foam slurry, such as through the conduits 29 seen in FIGS. 3 and 4 (e.g. with the flow 91 in basically the same direction of the flow 92 in FIG. 4); (b) withdrawing the foam through the element 90 (such as described above); and (c) passing a second, substantially fiber-free foam, into the first foam slurry (as indicated at 45 in both FIGS. 3 and 4) near where the first foam slurry is fed into the headbox 30, 301 (typically at manifold 27, or up to just past the point of introduction thereof) so as to provide a more uniform basis weight profile of the non-woven web produced (as seen in FIG. 6).

In the practice of the method according to the present invention, and utilization of the system, typical foam-laid process parameters that may be utilized are set forth in the following table (although the range of parameters can be wider if a product range is wider):

| PARAMETER | VALUE |
|---|---|
| pH (substantially entire system) | About 6.5 |
| temperature | About 20–40° C. |
| manifold pressure | 1–1.8 bar |
| consistency in mixer | 2.5% |
| consistency in headbox | .5–2.5% |
| particle, filler, or other additive consistency | About 5–20% |
| consistency of formed web | About 40–60% |
| web basis weight variations | Less than ½% |
| foam density (with or without fibers) | 250–450 grams per liter at 1 bar |
| foam bubble size | .3–.5 mm average diameter (a Gaussian distribution) |
| foam air content | 25–75% (e.g. a 60%; changes with pressure in the process) |
| viscosity | there is no "target" viscosity, but typically the foam has viscosity on the order of 2–5 centipoises under high shear conditions, and 200 k–300 k centipoises at low shear conditions, which ranges may be wider depending on the manner of determining viscosity. |
| web formation speed | about 200–500 meters per minute |
| specific gravity of fibers or additives | anywhere in the range of .15–13 |
| surfactant concentration | depends on many factors, such as water hardness, pH, type of fibers, etc. Normally between 0.1–0.3% of water in circulation |
| forming wire tension | between 2–10N/cm |

-continued

| PARAMETER | VALUE |
|---|---|
| exemplary flow rate | |
| mixer to wire pit | about 4000 liters per minute |
| wire pit to headbox | about 40,000 liters per minute |
| foam recycle conduit | about 3500 liters per minute |
| suction withdrawal to water recycle | about 500 liters per minute |

Figure 7:
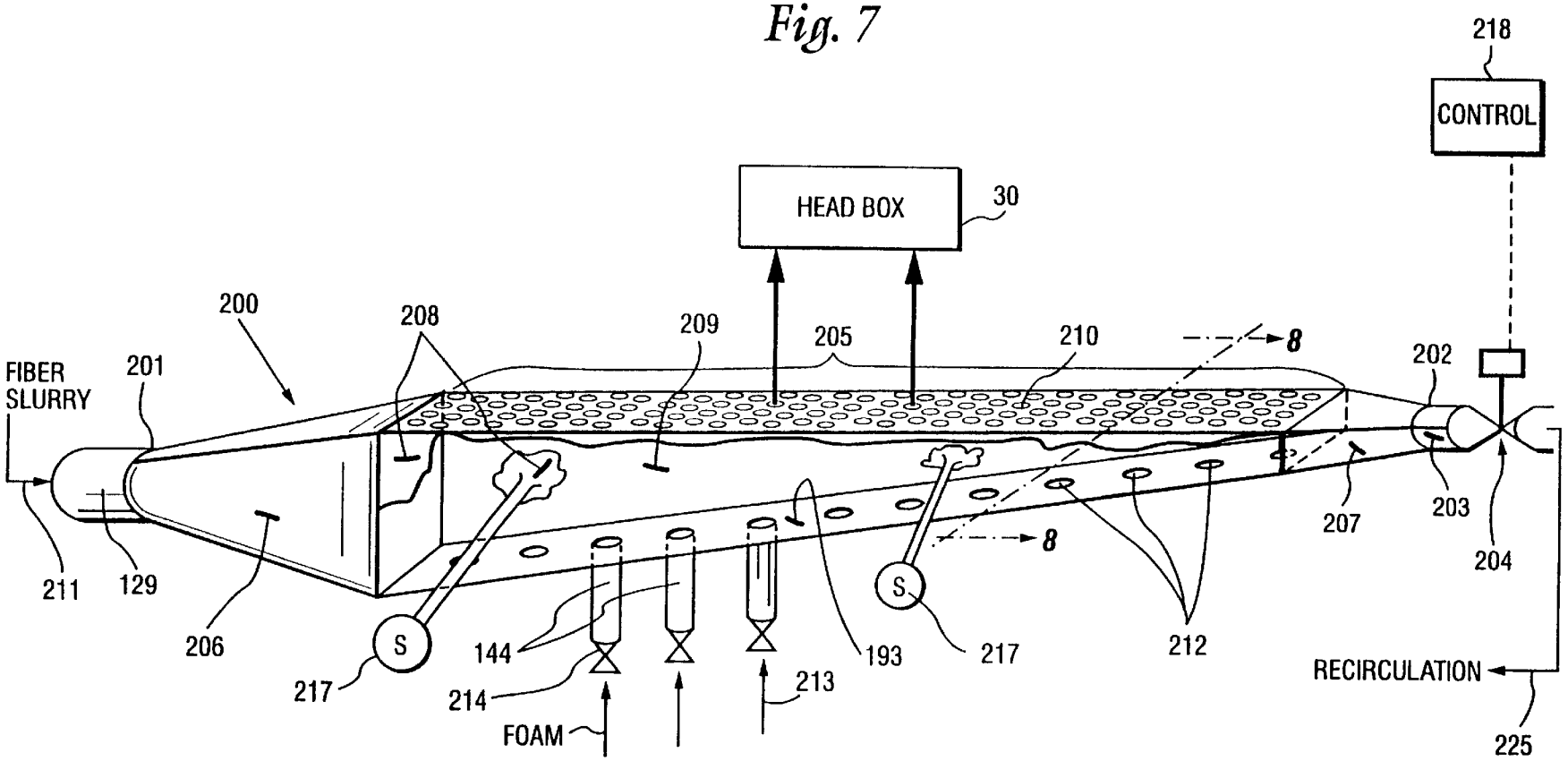
FIG. 7 is a perspective schematic view, with one of the side walls cut away for clarity of illustration, of a manifold facilitating production of a nonwoven web of fibrous material using the foam process, according to the invention.
Figure 8:
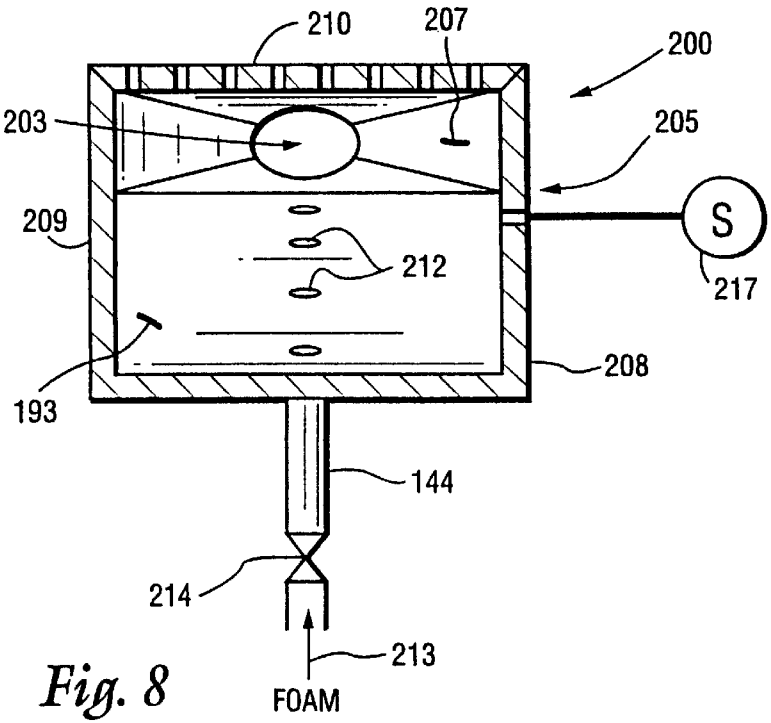
FIG. 8 is a cross-sectional view taken along lines 8—8 of FIG. 7.

What has heretofore been described is what is disclosed in pending U.S. patent application Ser. No. 08/923,250 filed Sep. 4, 1997, now U.S. Pat. No. 5,904,809. According to the present invention a particular manifold, and method of making a nonwoven web using the manifold, are provided which facilitate production of a nonwoven web having a substantially constant basis weight profile across the width thereof. In FIGS. 7 and 8 components similar to those illustrated in FIG. 4 are shown by the same reference numeral only preceded by a "1". Other components have a reference numeral that starts with a "2".

Figure 12:
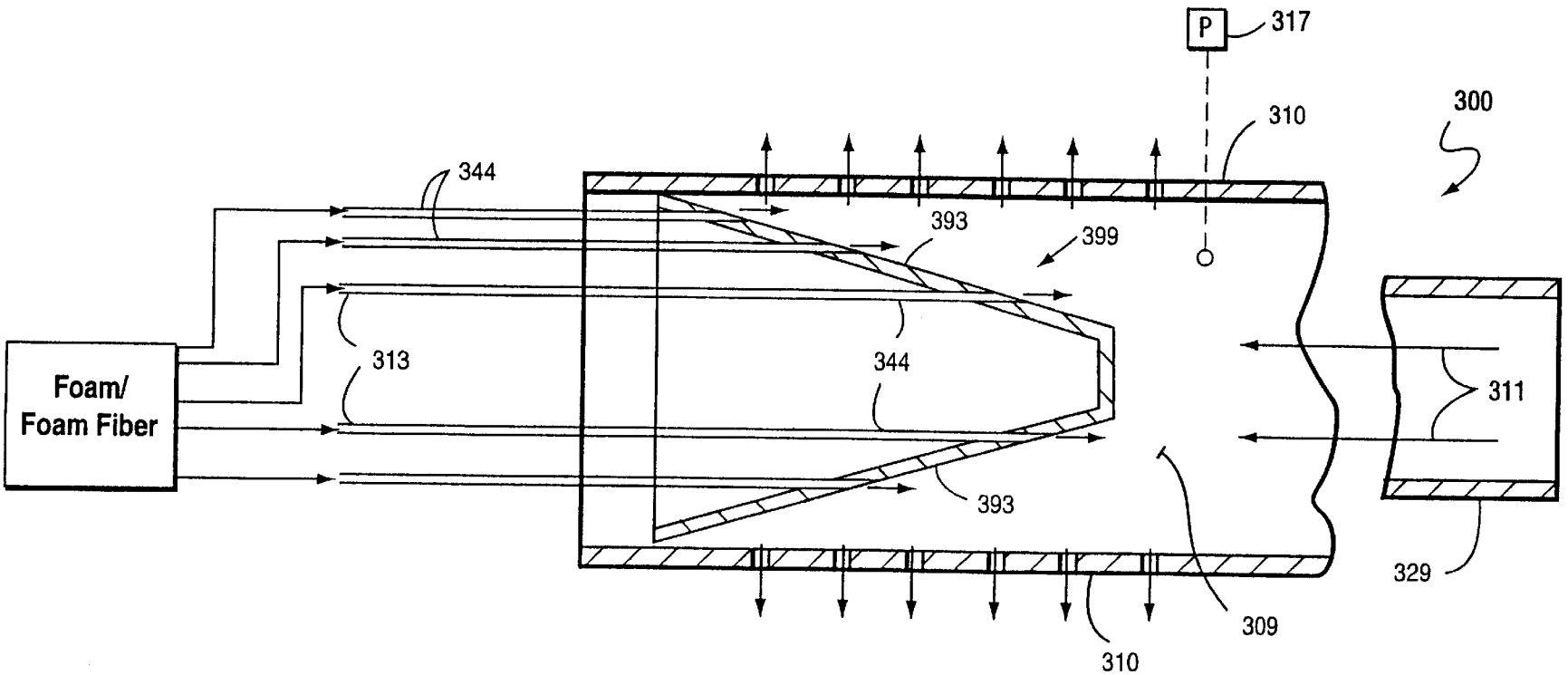
FIG. 12 is a side cross-sectional view of a manifold embodiment having a substantially circular cross-section and a conical insert.

The manifold according to the present invention may have the construction illustrated schematically at 200 in FIGS. 7 and 8, though many other shapes (including cylindrical with a conical insert, curved side wall, etc.) may be used such as the substantially cylindrical shape schematically illustrated in FIG. 12 where components comparable to those in FIG. 8 are shown by the same two-digit reference numeral only preceded by a "3" rather than a "1" or "2". A conical insert is normally not used where the front wall (210, 310) is planar since that would make the construction too complicated and expensive.

The manifold 200 of FIGS. 7 and 8 comprises a casing having a first end 201 with an inlet 129, and a second end 202, optionally with an outlet 203 leading to a manually or preferably automatically controllable valve 204. If the inlet 129 is circular in cross-section, as illustrated in FIG. 7, and so is the outlet 203, then in this preferred embodiment the manifold 200 comprises a center section 205 which is preferably a polygon based truncated prism, with a transition 206 from the circular cross-section inlet 129 to the polygon base of the center section prism 205, and with another transition 207 from the truncated top of the prismatic center section 205 connected to the outlet 203 (if provided).

The center section 205 of the manifold 200 comprises a first side wall 208, and a second side wall 209. In FIG. 7 the first side wall 208 is removed over most of the length thereof for clarity of illustration of the hollow interior and components thereof. However both of the side walls 208, 209 preferably are substantially closed, although various openings may be provided therein for sensors, or for other purposes. The side walls 208, 209 may be substantially planar or curved (e.g. see 308, 309, in FIG. 12).

The center section 205 also comprises a front wall 210 having an effective length (which may be from one transition 206 to the other transition 203, or some smaller part of that distance) and a back wall 193 opposite the front wall 210. The front wall 210 is porous to the foam-fiber-surfactant slurry 211 that enters the inlet 129, while the back wall 193 is substantially closed except for openings 212 therein through which a second foam, as indicated schematically by arrows 213 in FIGS. 7 and 8, may be introduced into the interior volume of the center section 205. The back wall 193 may be substantially planar or curved (e.g. see 393 in FIG. 12).

While for simplicity the second foam flow 213 will be described below as comprising substantially fiber-free foam, that is only a preferred embodiment and under many circumstances the use of foam containing fiber (at approximately the same percentage of fibers as the foam-fiber slurry introduced at 211, or with a 1% or more lesser or greater percentage of fiber than that of the slurry introduced at 211) may be used as the second foam 213. At different points of introduction the foam streams 213 may also have different percentages of fiber.

The pipes 144, with valves 214 therein, connected in a fluid-tight manner to the openings 212, comprise one embodiment for introducing the substantially fiber-free foam 213 into the center section through the back wall 193. The pipes 144, and openings 212, may be provided in a single row as illustrated in FIGS. 7 and 8, or in multiple rows, or in a wide variety of other patterns or arrays. Any other conventional fluidic elements, such as nozzles, heads, perforated plates, baffles, or the like, may be utilized as, or as part of, the means for introducing the foam 213, but preferably the means is capable of introducing foam 213 at a wide variety of different locations along the length of the center section 205 to change the pressure conditions within the center section 205 at any one point, so as to ultimately make the basis weight of the foam-fiber-surfactant slurry passing through the front wall 210 substantially constant along the effective length thereof (e.g. with a variation of less than 0.5%, preferably as low as about 0.2% or even lower).

Figure 13:
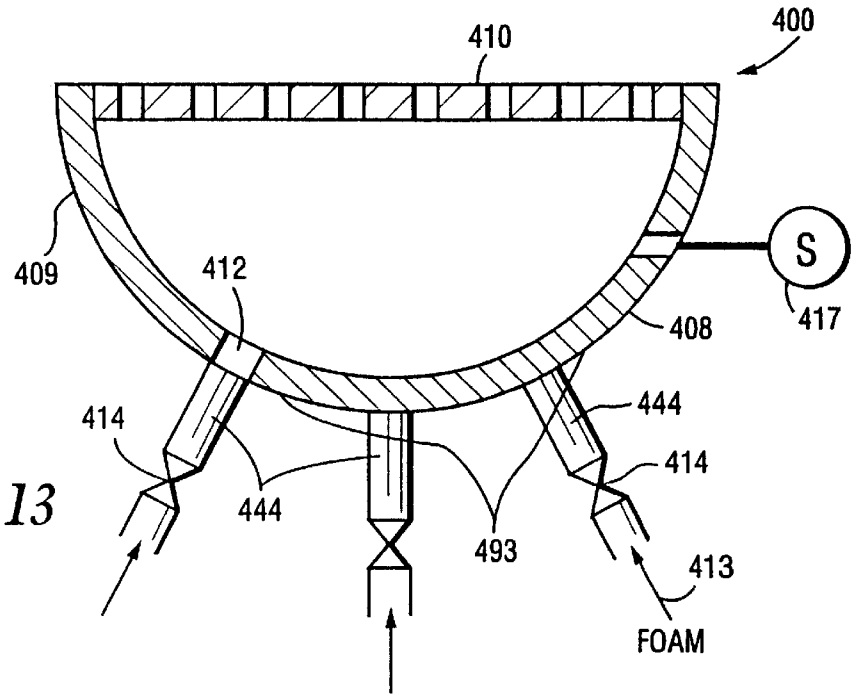
FIG. 13 is a view like that of FIG. 8 only showing a manifold having a substantially split conical cross-section.

The pressure within the central section 205 is preferably sensed in order to ensure that the basis weight is substantially constant since the basis weight at any particular point is largely dependent upon the pressure of the foam-fiber slurry at that point. For example as illustrated schematically in FIGS. 7 and 8, a plurality of pressure sensors 217 may be provided associated with the side wall 208 (or with each of the side walls 208, 209). Alternatively the front wall 210 may be planar and the back and side walls 193, 208, 209 may be formed of one curved surface, preferably part of a circle or cone, as illustrated schematically in FIG. 13. Thereby, both the pressure sensors 217 and the foam introduction ducts 144 can be placed one or more at back/side wall 15, 193, 208, 209.)

The sensors 217 may be pressure meters or any other type of conventional sensor, preferably which provides an electronic readout or pulse. Preferably the outputs from each of the sensors 217 (any number may be provided, the more that are provided typically the more uniform the basis weight will be) are electronically connected to automatic control means, shown schematically at 218 in FIG. 7. In response to the output from the pressure sensors 217, as well as other environmental or human induced factors, the control means 218 controls the valve 204, the pump pumping slurry 211 to the inlet 129 (e.g. the pump 25 illustrated in FIGS. 1 and 2), the valves 214 supplying the second foam 213 to the center section 205, or preferably all of the valve 204, pump 25, and valves 214. By controlling the valve 204 by opening it further, the pressure within the former 205 is reduced, and by closing it more the pressure in the center section 205 is increased; by increasing the pump 25 speed the pressure will be increased, and by decreasing the speed the pressure will be decreased; and by controlling the valves 214 the amount of flow at any particular point along the back wall 193 is individually controlled to thereby locally increase or decrease the pressure at that point.

In the preferred embodiment illustrated, the back wall 193 slopes with respect to the front wall 210 so that the back wall 193 becomes closer to the front wall 210, and the cross-sectional area of the center section 205 becomes smaller, moving from adjacent the first end 201 of the manifold 200 toward the second end 202, as is clear in FIG. 8. Preferably the slope of the back wall 193 is substantially uniform so that the decrease in cross-sectional area is also uniform, although a non-uniform slope may be provided if balanced off by modifications of the substantially fiber-free foam introduction means, or the like.

The control means 218 may comprise any suitable conventional control means such as a fuzzy controller, a multivariable control unit, or any other suitable computer control capable of performing the desired function of controlling valves 204 and 214, and possibly pump 25.

Figure 11:
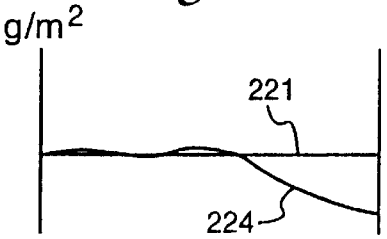
FIGS. 10 and 11 are graphs like that of FIG. 9 only showing aberrant conditions.
Figure 10:
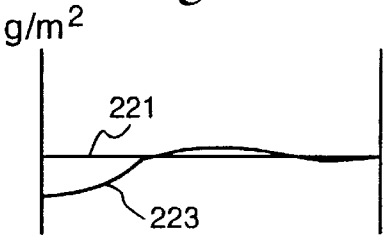
Figure 9:
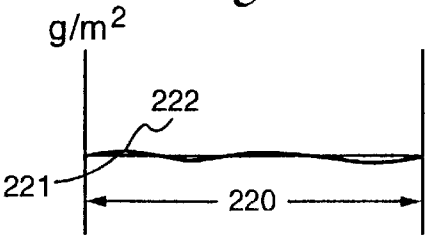
FIG. 9 is a graphical representation of an exemplary slurry profile that can be obtained by utilizing the invention of FIGS. 7 and 8.

FIG. 9 is a graphical representation of the basis weight of the foam-fiber slurry passing through the front wall 210 along the length of the center section 205. The effective length of the center section 205 is indicated by reference numeral 220 in FIG. 9, whereas variations of basis weight with respect to a constant 221 (typically in grams per square meter) is illustrated via line 222. The variation in FIG. 9 is less than 0.5% from the peak of the curve 222 above the base line 221, to the valve below. FIGS. 10 and 1 1, on the other hand, have curves 223, 224, respectively, which result in an unsuitable product. FIG. 10 shows a situation where an insufficient amount of slurry flows into the manifold leading to a manifold pressure that is too low at the inlet, 129, and thus a basis weight at the left hand side of the manifold 200 as viewed in FIG. 7 that is too low. FIG. 11 shows an aberrant situation where too much slurry is recirculated in line 225 (e.g. back to pump 25, or to wire pit 23) because the valve 204 is open too far, resulting in a decrease of pressure in the manifold and the basis weight of the slurry passing through the front wall 210 to the right of the manifold 200 (as seen in FIG. 7) being too low.

FIG. 7 also shows the manifold 200 in schematic relationship with respect to a conventional headbox 30; that is the manifold 200 preferably takes the place of the manifold 27 illustrated in FIGS. 1 and 3, and has nozzles associated therewith (like 28 and 29 in FIG. 3), which feed the headbox 30 containing the wire 99 and with which the suction boxes 31 are associated.

In a method of utilizing the manifold 200 according to the present invention for producing a nonwoven web of fibrous material the following procedures may be practiced: (a) Substantially continuously introducing foam-fiber-surfactant slurry 211 into the first end 201 of the manifold 200. (b) Substantially continuously discharging foam-fiber-surfactant slurry 211 through openings in the manifold front wall 210 to be delivered to the headbox 30. And, (c) introducing a second foam 213 (substantially fiber free, or a foam-fiber slurry) into the manifold through a number of openings 212 spaced at substantially regular intervals substantially over the entire length thereof, so as to maintain the basis weight of foam-fiber-surfactant slurry passing through the manifold front wall 210 substantially constant along the effective length 220 of the manifold front wall 210 (as seen by curve 222 in FIG. 9); e.g. so that there is a variation of 0.5% or less in the basis weight of the slurry passing through front wall 210, and the web ultimately formed on the foramininous element 99.

The method may also comprise (d) sensing the pressure in the manifold 200 at a plurality of positions (sensors 217) along the length thereof, and controlling (c) in response to the sensed pressure to maintain the basis weight of the slurry passing through the front wall 210 substantially constant (preferably with a variation of less than 0.5%) along the effective length 220 of the front wall 210. For example this is accomplished by the sensors 217 providing control signals to the control means 218, which then controls the valves 214 as needed (and possibly the valve 204, and also possibly the speed of the pump 25). In the method (c) is also preferably practiced substantially continuously, although the rate of flow may be varied from one pipe 144 to the other in order to achieve a uniform pressure within the manifold center section 205, and the slurry 211 moves through the constantly decreasing cross-section of the center section 205 (as seen in FIG. 8) from the inlet 129 to the outlet 203.

The manifold 300 of FIG. 12 has a cylindrical cross-section with conical insert 399. In FIG. 12 the uppermost and the lowermost structures represent the 'front wall' 310 of the manifold having apertures and further connections to the headbox. The fiber-foam mixture 311 enters the manifold 300 from the right. The tapering part inside the manifold is the conical insert 399 corresponding to the 'back wall' of the manifold. I.e. both have circular cross section. As shown the second foam 313 enters the conical insert 399 via a plurality of pipes 344 terminating into an opening at the conical "back wall" 393. The pressure sensors 317 may be located in the "side" wall 309. Further, it should be noted that the manifold 300 could be conical, and the insert (399) cylindrical, or both conical. Other cross sections than cylindrical could also be used, for instance elliptical cross sections, or the configuration of FIG. 13 in which the surface 408, 409, 493 is curved and preferably a bisected cone [in FIG. 13 components comparable to those of FIGS. 7, 8 and 12 are shown by the same two digit number only preceded by a "4"].

It is the primary object of the present invention to provide highly advantageous modifications of the foam-laid process. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent methods and assemblies.

What is claimed is:

1. A method of producing a nonwoven web of fibrous material, using a manifold having a front porous wall having an effective length through which foam-fiber slurry flow out of the manifold, first and second ends adjacent the front porous wall and separated along the effective length, and a back wall adjacent the first and second ends and opposing the front wall; and a headbox downstream of the front porous wall; said method comprising:

(a) substantially continously introducing foam-fiber-surfactant slurry into the first end of the manifold;

(b) substantially continously discharging foam-fiber-surfactant slurry through openings in the manifold front wall to be delivered to the headbox; and (c) introducing a second foam into the manifold through a number of openings spaced at substantially regular intervals over the entire length thereof, so as to maintain the basis weight of foam-fiber-surfactant slurry passing through the manfold front wall substantially constant along the effective length of the manifold front wall.

2. A method as recited in claim 1 further comprising (d) sensing a pressure in the manifold at a plurality of positions along the length thereof, and practicing (c) in response to the sensed pressure to maintain the basis weight of foam-fiber slurry passing through the front wall with a variation of less than 0.5% along the effective length of the front wall.

3. A method as recited in claim 1 wherein the manifold has a valved outlet at the second end thereof; and further comprising (e) automatically controlling the valve of the outlet to control the amount of slurry flowing out of the outlet; and wherein (c) is practiced by controlling valves in pipes feeding the second foam through the back wall center section between the first and second ends thereof with a substantially polygonal cross-section that gradually decreases substantially along the effective length of the front wall; and wherein (c) is practiced so that the foam-fiber-surfactant slurry moves through the constantly decreasing cross-section of a center section.

4. A method as recited in claim 1 wherein (c) is practiced substantially continuously.

5. A method as recited in claim 1 wherein (c) is practiced to introduce substantially fiber-free foam as the second foam.

6. A method as recited in claim 1 wherein (c) is practiced to introduce a foam-fiber slurry as the second foam.

7. A method as recited in claim 1 wherein (c) is practiced to introduce a foam-fiber slurry having approximately the same percentage of fibers as the foam-fiber slurry introduced in (a).

8. A method as recited in claim 1 wherein (c) is practiced to introduce a foam-fiber slurry having a different, by at least about 1%, percentage of fibers as the foam-fiber slurry introduced in (a).

* * * * *